United States Patent [19]

Bell

[11] Patent Number: 4,594,933

[45] Date of Patent: Jun. 17, 1986

[54] MUZZLE BRAKE FOR DISPERSAL OF AN AEROSOL FROM A CANNON

[75] Inventor: Frank H. Bell, Logan, Utah

[73] Assignee: Thiokol Corporation, Chicago, Ill.

[21] Appl. No.: 569,808

[22] Filed: Jan. 11, 1984

[51] Int. Cl.[4] ..... F41F 17/12

[52] U.S. Cl. ..... 89/14.3

[58] Field of Search ..... 89/14.3

[56] References Cited

U.S. PATENT DOCUMENTS 2,966,682 1/1961 Henning ..... 89/14.3

4,436,017 3/1984 Mohlin ..... 89/14.3

*Primary Examiner*—Stephen C. Bentley

*Attorney, Agent, or Firm*—Gerald K. White

[57] ABSTRACT

Conventional cannon and tank cannon frequently incorporate a muzzle brake device in order to reduce weapon recoil. Recently tank cannon have acquired the need to eject and disperse infrared (IR) signature masking aerosols, even when the weapon is muzzle brake equipped. The incorporation of an aerosol dispersal feature into a cannon is accomplished by the addition of metallic vortex generators, comprising blades or teeth that extend into the blast stream, to the muzzle brake.

4 Claims, 5 Drawing Figures

MUZZLE BRAKE FOR DISPERSAL OF AN AEROSOL FROM A CANNON

BACKGROUND OF THE INVENTION

1. Field of the Invention

The present invention relates to the dispersal of a protective aerosol by gun ejection for enabling a better defense of armored vehicles such as tanks against optically guided anti-armor missiles.

2. Description of the Prior Art

Optical techniques have come into use for reconnaissance, sight and fire directing equipment, target searching and laser guided missiles, warning devices and distance measuring devices. As the result of such developments, and particularly of improvements in electro-optical detectors for long wave radiation in the infrared (IR) range, the electro-optical threat with regard to military objects such as tanks and other conventional armored vehicles has increased significantly. Natural protection such as mist, fog or darkness no longer is an effective defense against such improved detectors. Thus, there is a need in the art for a better means of defense of conventional armored vehicles including tanks against optically guided anti-armor missiles.

SUMMARY OF THE INVENTION

An object of the invention is to provide for armored vehicles, in a simple and effective manner, a capacity for ejecting and dispersing IR signature masking materials thereby to offer such vehicles a better chance for defense against optically guided anti-armor missiles.

A more specific object of the invention is to provide such an IR signature masking capacity for conventional cannon and tank cannon that incorporate a muzzle brake device in order to reduce weapon recoil.

In achieving these and other objectives of the invention, a muzzle brake device that frequently is incorporated in conventional cannon and tank cannon in order to reduce weapon recoil is modified by the addition of properly located vortex generators for facilitating the dispersal of an IR signature masking aerosol. Specifically, the incorporation of the aerosol dispersal feature into a cannon may be accomplished by the addition of metallic vortex generators, which project into the blast stream, to existing muzzle brake devices. Where a cannon is not equipped with a muzzle brake device, it is to be understood that a modified muzzle brake device according to the invention may be incorporated therein in order to permit utilization of the aerosol dispersal feature of the invention.

BRIEF DESCRIPTION OF THE DRAWINGS

Having summarized the invention, a detailed description follows with reference being made to the accompanying drawings which form part of the specification, of which.

DESCRIPTION OF THE PREFERRED EMBODIMENT

Figure 1:
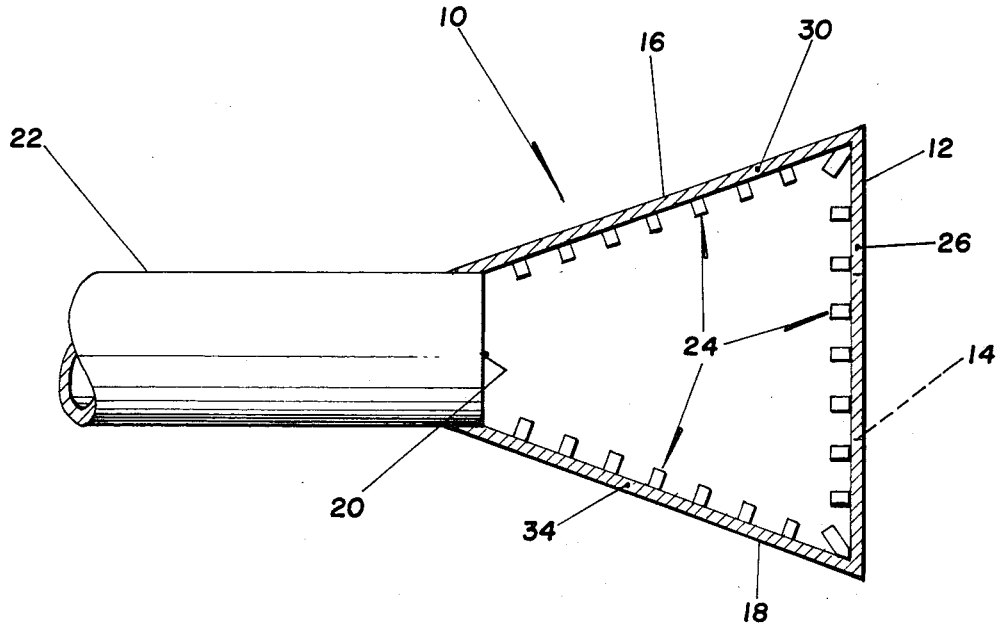
FIG. 1 is a side view of a cannon muzzle and attached muzzle brake, the muzzle brake having a single baffle and being provided with vortex generators comprising blades or teeth.
Figure 2:
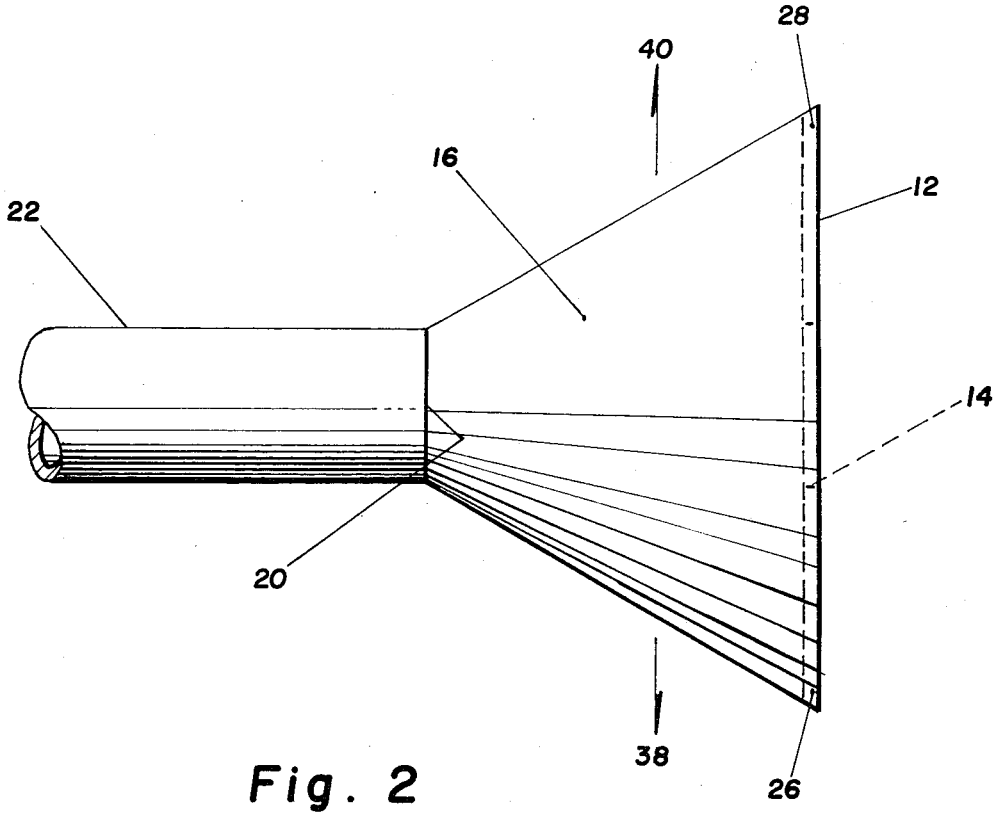
FIG. 2 is a top plan view of the cannon muzzle and muzzle brake of FIG. 1.
Figure 3:
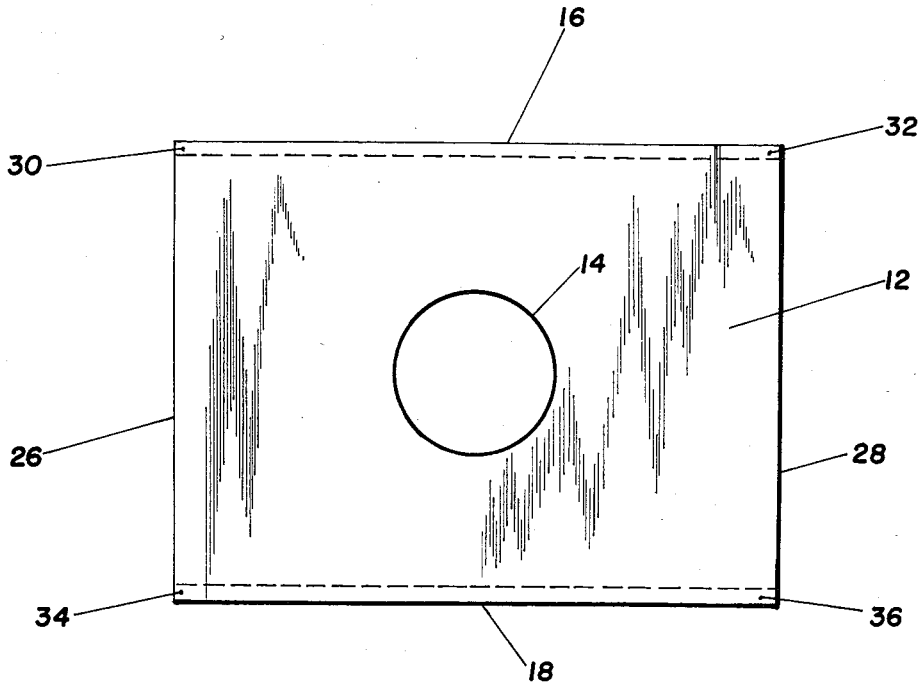
FIG. 3 is a front view of the cannon muzzle brake of FIG. 1.

The novel muzzle brake for dispersal of an IR masking aerosol from a cannon herein disclosed, and particularly as illustrated in FIGS. 1–5, is designated by the reference numeral 10 and comprises a single baffle 12 having a centrally located port 14 therein. Upper and lower imperforate plate elements 16 and 18, respectively, are provided for the support and attachment of the baffle 12, in spaced relation, to the muzzle or front end 20 of the barrel 22 of a cannon (not shown), with the port 14 in alignment with the muzzle 20. While a single baffle 12 has been illustrated in the drawings, it will be understood that a plurality of such baffles may be provided, if desired.

Figure 4:
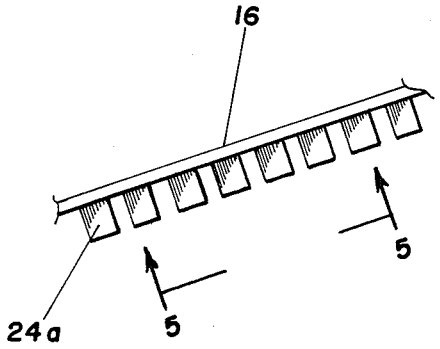
FIG. 4 is an enlargement of a portion of an element of the muzzle brake of FIG. 1.
Figure 5:
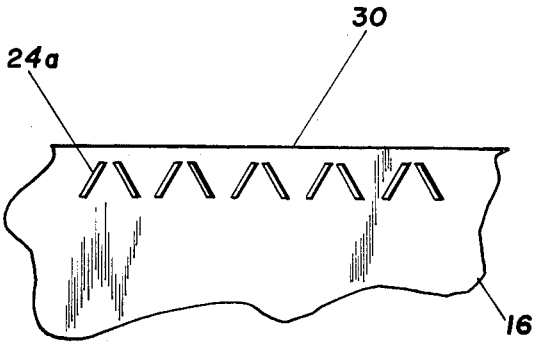
FIG. 5 is a view taken in the direction of the arrows 5–5 of FIG. 4.

In accordance with the invention, the incorporation of a mechanism to disperse IR signature masking aerosols from a cannon is accomplished by the addition to the muzzle brake 10 of a plurality metallic vortex generators, indicated generally by the reference numeral 24, that project into the blast stream of the expanding gases that are ejected from the cannon muzzle 20 when the cannon is discharged. As best seen in FIGS. 4 and 5, such vortex generators 24 comprise equally sized, equally spaced blades or teeth designated **24*a*, each of which extend into the blast stream of gases that are ejected from the muzzle 20 when the cannon is discharged. The blades 24*a* are provided adjacent the outside edges 26 and 28 of the baffle 12, the outside edges 30 and 32 of upper supporting element 16, and the outside edges 34 and 36 of the lower supporting element 18, with adjacent ones of the blades 24*a* being angularly positioned with respect to each other, as shown in FIG. 5. Blades 24*a* may, if desired, have an airfoil cross section. It is contemplated that many such blades 24*a*** may be provided.

In the operation of the muzzle brake 10, when the cannon is discharged, the gases from the charge expand as they are projected forwardly toward the baffle 12 from the muzzle 20. Some of the gases are projected forwardly to the atmosphere through the port 14, with the rest striking the surface of the baffle 12 that faces the muzzle 20 and being deflected sideways in opposite directions to the atmosphere or expanding sideways directly to the atmosphere, as indicated by the arrows 38 and 40 in FIG. 2.

As a result, the blast stream of gases from the charge exerts a forward thrust or force against the baffle 12 which imparts an opposing force against the recoil of the cannon blast. This greatly reduces the recoil impact of the blast and enables smaller bearings and less weighty mountings to be used for supporting the cannon. With the gases projecting sideways in opposite directions from the muzzle brake, as shown by the arrows 38 and 40, no net sideways thrust on the cannon muzzle 20 is produced.

As the deflected or expanding blast stream of gases flows over each of the plurality of blades **24*a* on the muzzle brake 10**, a violent turbulence or vortex is created at each one. The plurality of vortices so created are utilized, in accordance with the invention, to effect fast, uniform and complete and thereby optimum dispersal or spread of an aerosol package from muzzle brake equipped cannon.

It is noted that while the blades 24*a* have been illustrated as mounted near the outside edges 26 and 28 of the baffle 12, and near the outside edges 30, 32 and 34, 36 of the support elements 16 and 18, respectively, such blades 24*a*, if desired, may be made to extend all the way across the baffle 12 and support elements 16 and 18. Additionally, such elongated blades 24*a* may be formed, if desired, to provide undulating passages. As the gases pass through the undulating passages they are deflected from side to side of such passages and create additional turbulence for the more complete dispersal of an aerosol.

The muzzle brake for dispersal of an aerosol according to the present invention is not limited to the use of any particular aerosol for dispersing an IR signature mask. An aerosol or mist producing device having especial utility with the present invention, however, is the gun launched IR cloaking device disclosed in my copending application for patent filed on even date herewith and bearing Ser. No. 569,803. That cloaking device comprises an Aluminum salt, such as Aluminum Sulfate ($Al_2(SO_4)_3$) dissolved in a water carrier and packaged in a frangible canister for launch from a cannon with "sabot" type gas obturation. The powder charge is of a smokeless type and just large enough to cause gun ejection of the canister, canister rupture, and solution nebulization. Upon nebulization, the mist then absorbs, scatters, reflects, or diffracts the infrared signature of the vehicle being cloaked. Also, an IR laser beam from a tank gun sight or ranging device will be attenuated and scattered by the mist.

Thus, there has been provided, according to the present invention, a novel muzzle brake having an aerosol dispersal feature incorporated therein which permits fast, complete and uniform dispersal of IR signature masking aerosols from a cannon equipped therewith. The novel muzzle brake permits a cannon armed vehicle a low cost way to disperse a protective aerosol, and offers such vehicles a better chance for defense against optically guided anti-armor missiles.

What is claimed is:

1. A muzzle brake for dispersal of an aerosol from a cannon comprising, a baffle, said baffle having a centrally located port therein, upper and lower imperforate plate elements for the attachment of said baffle, in spaced relation, to the muzzle of the cannon barrel with said port in alignment with the muzzle of the cannon, and a plurality of blades formed on the surfaces of said baffle and of said plate elements that face the muzzle of the cannon barrel, said blades extending into the blast stream of gases including the aerosol that are ejected from the muzzle when the cannon is discharged thereby to create a plurality of vortices for the optimum dispersal of the aerosol.

2. A muzzle brake for dispersal of an aerosol from a cannon as specified in claim 1 wherein said plurality of blades on said baffle and on said upper and lower plate elements are equally sized and equally spaced thereon.

3. A muzzle brake for dispersal of an aerosol from a cannon as specified in claim 2 wherein plurality of blades on said baffle and on said upper and lower plate elements are provided adjacent the outside edges thereof.

4. A muzzle brake for dispersal of an aerosol from a cannon as specified in claim 3 wherein adjacent ones of said blades are angularly positioned with respect to each other.

* * * * *